US011404816B2

(12) United States Patent
Schüssler et al.

(10) Patent No.: US 11,404,816 B2
(45) Date of Patent: Aug. 2, 2022

(54) SPRING-BIASED PLUG CONNECTOR FOR CONNECTING AN ELECTRICAL ATTACHMENT CABLE TO A MATING PLUG CONNECTOR OF AN ELECTRICAL APPLIANCE

(71) Applicant: Festool GmbH, Wendlingen (DE)

(72) Inventors: Erik Schüssler, Leonberg (DE); Thomas Mosthaf, Esslingen (DE); Nicolai Knecht, Pliezhausen (DE)

(73) Assignee: FESTOOL GMBH, Wendlingen (DE)

( * ) Notice: Subject to any disclaimer, the term of this patent is extended or adjusted under 35 U.S.C. 154(b) by 0 days.

(21) Appl. No.: 17/047,804

(22) PCT Filed: Apr. 9, 2019

(86) PCT No.: PCT/EP2019/058950
§ 371 (c)(1),
(2) Date: Oct. 15, 2020

(87) PCT Pub. No.: WO2019/201676
PCT Pub. Date: Oct. 24, 2019

(65) Prior Publication Data

US 2021/0167546 A1 Jun. 3, 2021

(30) Foreign Application Priority Data

Apr. 19, 2018 (DE) ..... 102018109411.6

(51) Int. Cl.
*H01R 13/56* (2006.01)
*H01R 13/623* (2006.01)
*H01R 13/625* (2006.01)

(52) U.S. Cl.
CPC ..... *H01R 13/562* (2013.01); *H01R 13/623* (2013.01); *H01R 13/625* (2013.01)

(58) Field of Classification Search
None
See application file for complete search history.

(56) References Cited

U.S. PATENT DOCUMENTS 2,447,783 A 8/1948 Williams
2,833,997 A 5/1958 Brown
(Continued)

FOREIGN PATENT DOCUMENTS

CN 102820587 A 12/2012
CN 105164860 A 12/2015
(Continued)

*Primary Examiner* — Ross N Gushi
(74) *Attorney, Agent, or Firm* — Hoffmann & Baron, LLP

(57) ABSTRACT

A plug connector for connecting an attachment cable to a mating plug connector of an electrical appliance in the form of a vacuum cleaner, wherein the plug connector has a contact carrier having plug contacts which are connected or connectable to the attachment cable and which can be brought into an electrical contact position with mating plug contacts of the mating plug connector by a plugging movement along a plug axis, wherein the contact carrier is received, in an axially movable manner with respect to the plug axis, in a plug housing which is mounted rotatably about the plug axis with respect to the contact carrier, wherein rotary form-fit contours are arranged on the plug housing and can be brought into form-fit engagement with mating rotary form-fit contours of the mating plug connector by a rotation movement of the plug housing about the plug axis with respect to the contact carrier, such that the plug connector is secured on the mating plug connector in a tension-resistant manner with respect to the plug axis, and wherein the plug connector has a cable sleeve for the attachment cable.

29 Claims, 4 Drawing Sheets

(56) References Cited

U.S. PATENT DOCUMENTS

| | | | | |
|---|---|---|---|---|
| 2,984,811 | A * | 5/1961 | Hennessey, Jr. ..... | H01R 13/623<br>439/153 |
| 3,287,031 | A | 11/1966 | Simmons et al. | |
| 3,986,765 | A | 10/1976 | Shaffer et al. | |
| 4,929,189 | A | 5/1990 | Sekiguchi | |
| 7,435,112 | B1 | 10/2008 | Miller et al. | |
| 1,304,075 | A1 | 5/2019 | Lofgren | |
| 2017/0264049 | A1 | 9/2017 | Tiberghien et al. | |

FOREIGN PATENT DOCUMENTS

| | | | |
|---|---|---|---|
| DE | 1747477 | U | 6/1957 |
| DE | 2604896 | A1 | 8/1976 |
| DE | 68916586 | T2 | 12/1994 |
| DE | 202008013795 | U1 | 4/2009 |
| EP | 2989686 | A1 | 3/2016 |
| JP | H0371571 | A | 3/1991 |
| WO | 2014/172795 | A1 | 10/2014 |

* cited by examiner

SPRING-BIASED PLUG CONNECTOR FOR CONNECTING AN ELECTRICAL ATTACHMENT CABLE TO A MATING PLUG CONNECTOR OF AN ELECTRICAL APPLIANCE

This application claims priority based on an International Application filed under the Patent Cooperation Treaty, PCT/EP2019/058950, filed Apr. 9, 2019, which claims priority to DE 102018109411.6, filed Apr. 19, 2018.

BACKGROUND OF THE INVENTION

The invention relates to a plug connector for connecting an attachment cable to a mating plug connector of an electrical appliance in the form of a vacuum cleaner or an in particular mobile machine tool, wherein the plug connector has a contact carrier having plug contacts which are connected or connectable to the attachment cable and which can be brought into an electrical contact position with mating plug contacts of the mating plug connector by a plugging movement along a plug axis, wherein the contact carrier is received, in an axially movable manner with respect to the plug axis in a plug housing which is mounted rotatably about the plug axis with respect to the contact carrier, wherein rotary form-fit contours are arranged on the plug housing and can be brought into form-fit engagement with mating rotary form-fit contours of the mating plug connector by a rotation movement of the plug housing about the plug axis with respect to the contact carrier, such that the plug connector is secured on the mating plug connector in a tension-resistant manner with respect to the plug axis, and wherein the plug connector has a cable sleeve for the attachment cable.

In the case of electrical appliances of the applicant, such a plug connector is used to supply the electrical appliance with energy. The attachment cable and the plug connector of hand-held machine tools or similar, in particular semi-stationary machine tools, are exposed to particular mechanical stress, for example due to vibrations during operation of the electrical appliance. Accordingly, a reliable connection between the plug connector and the attachment cable and the mating plug connector, which is located on the electrical apparatus, is necessary. The rotary locking thus facilitates a tension-resistant connection between the plug connector and the mating plug connector. However, in practice it is difficult to maintain a permanent electrical connection between the plug connector and the mating plug connector which is reliable in different environments, i.e. to reliably maintain the contact position between the two components.

Further plug connectors with rotary form-fit contours are known from U.S. Pat. Nos. 2,447,789, 1,304,075 and 3,287,031. Plug connectors with cable sleeves are described in DE 20 2008 013 795 U1 and DE 1747477.

Plug connectors with spring-loaded contacts are known from U.S. Pat. No. 2,833,997 and WO 2014/017795 A1. Further plug connectors are derived from U.S. Pat. No. 7,435,112 B1 and US 2017/0264049 A1.

SUMMARY OF THE INVENTION

It is therefore the object of the present invention to provide a plug connector suitable for reliable connection to a mating plug connector.

To achieve the object, it is provided that a plug connector of the type mentioned at the outset is designed such that the contact carrier is spring-loaded with respect to the plug housing in the contact position in the direction of the plug axis by means of a spring element separate from the cable sleeve, which is supported on the contact carrier and on the plug housing.

It is a basic concept of the invention that, independently of or in addition to the cable sleeve, a spring element is provided which loads the contact carrier into the contact position. This additional spring element is not formed from the cable sleeve, but a separate component of the cable sleeve. Thus, the spring properties of the spring element can be optimally selected and/or adjusted in order to provide a permanent reliable spring loading of the contact carrier relative to the plug housing. For example, the spring element can be provided with a preload, so that it is used in a favourable working range of its spring characteristic curve. Thus, for example, a spring element with a comparatively soft spring characteristic curve can be provided. For example, the spring element has a much softer or more constant spring property than the cable sleeve or its section that engages in the plug housing. The preload force or spring force does not change or only changes insubstantially over the lifetime of the spring element.

With the applicant's former design, the section of the cable sleeve which engages in the plug housing is virtually a spring element which spring-loads the contact carrier into the contact position. However, the cable sleeve is a plastic component, possibly a rubber component, which is subject to ageing tendencies, for example embrittlement. In addition, the spring properties of a cable sleeve are largely dependent on temperature. Correspondingly, the novel invention provides a much more reliable connection between the plug connector and the mating plug connector, i.e. between the attachment cable and the electrical appliance.

At this point it should be mentioned that the plug connector may have a longitudinal plug axis which is coaxial with and/or parallel to or formed by the plug axis.

The longitudinal plug axis can thus be the plug axis or correspond to the plug axis.

Furthermore, the plug axis can represent or form a displacement axis, along which the plug housing and the contact carrier can be axially displaced relative to one another.

Furthermore, the plug axis or the longitudinal plug axis can represent an axis of rotation, around which the plug housing is rotatably mounted with respect to the plug. The plug housing is rotatably mounted about an axis of rotation relative to the contact carrier and/or the contact carrier is displaceably mounted about a displacement axis relative to the plug housing. The axis of rotation and the displacement axis can be coaxial. The axis of rotation and the displacement axis can be the plug axis or be formed by the plug axis or be parallel to the plug axis.

The machine tool is preferably a hand-held machine tool. The hand-held machine tool can comprise a plug connector according to the invention.

The machine tool can also be a so-called semi-stationary machine tool, for example a machine tool that can be taken to a place of use. The semi-stationary hand-held machine tool can be, for example, a mobile saw, in particular a cross-cut saw, a circular table saw or similar.

The electrical appliance can be, for example, a saw, in particular a mobile or semi-stationary circular saw, a plunge saw, a jigsaw or similar. The electrical appliance or the hand-held machine tool can also be a router, a drill, a drilling machine or similar.

Furthermore, an attachment cable with a plug connector according to the invention lies within the scope of the invention.

The plug connector can also have an attachment cable or the attachment cable can be integral.

The invention further relates to a system comprising an electrical appliance in the form of a vacuum cleaner or a mobile machine tool, in particular a hand-held machine tool, and at least one plug connector according to the invention, in particular an attachment cable with a plug connector according to the invention.

The spring element can be directly supported on the plug housing with respect to the plug axis. However, it is also possible for the spring element to be supported by means of a supporting body on the plug housing, which is also supported on the plug housing. For example, the plug housing has a support projection or a support receptacle on which the supporting body is supported. For example, the supporting body can have a support surface which extends radially inwards, in the direction of the plug axis or the longitudinal plug axis.

The spring element is expediently completely or substantially completely supported on the plug housing. This means that the spring force with respect to the plug axis is introduced completely or substantially into the plug housing.

However, it is also possible for the cable sleeve or a spring-loaded flexible section of the cable sleeve to represent an addition spring loading. Thus, a measure can be provided such that the spring element is supported on a spring-loaded flexible section of the cable sleeve which in turn is supported on the plug housing. A section of the cable sleeve received in the plug housing or protruding into the plug housing can, for example, be made of an elastic or flexible plastic, rubber or similar material. The spring element is then supported on this spring-loaded flexible section. For example, the spring element and the spring-loaded flexible section are connected in series, so to speak, in terms of spring effect. This allows, for example, a longer spring travel, a more favourable spring effect or similar.

However, it is advantageous if the spring element is not or is only insubstantially supported on the cable sleeve, but is supported on the plug housing. Of course, the cable sleeve can also have a supporting function. In particular, this is then advantageous if the cable sleeve has a supporting section, which is substantially bend-resistant and is in turn supported on the plug housing with respect to the plug axis. Thus, for example, a section of the cable sleeve which engages in the plug housing or which is received in the plug housing can have a corresponding bending stiffness or load capacity for supporting the spring element.

However, it is advantageous if, for example, the above-mentioned supporting body keeps a spring force of the spring element completely or substantially away from the cable sleeve.

However, this measure does not rule out the possibility of the supporting body resting on the cable sleeve. An advantageous measure provides that the supporting body rests on the cable sleeve at least in sections.

The supporting body can be plate-shaped or disc-shaped.

It is preferred if the supporting body has a passage opening for the attachment cable.

It is easily possible for the plug connector to contain not only one spring element, but a plurality of spring elements. At least one of the spring elements preferably consists of metal or is formed by a metal spring. However, it is also possible, for example, for an elastic plastic body, rubber body, caoutchouc body or similar to be provided as the spring element or to form one of the spring elements. A combination of a metal spring element and a spring element made of plastic material or rubber is also easily possible. Thus, the spring properties can be optimally adjusted.

The spring element is expediently preloaded between the contact carrier and the plug housing. Consequently, the spring element is not relaxed, even if the contact carrier is moved from the contact position to an adjustment removed from a free end region of the plug housing.

During an axial adjustment of the contact carrier with respect to the plug housing along the plug axis there is a change in the spring force of the spring element of at most 20%, in particular also at most 15% or at most 10%. Preferably, the spring force changes in the region of the travel path between the contact carrier and the plug housing by at most 25%, particularly preferably in a range from 5% to 15%. The spring element is operated or used in the region of its soft characteristic curve or a characteristic curve with substantially constant spring force. The spring element acts on the contact carrier in the region of its soft characteristic curve or characteristic curve with substantially constant spring force.

Furthermore, it is advantageous if the spring element is preloaded by at least 20%, preferably at least 30% of its length starting from its, in particular, completely relaxed position. It is also possible for the spring element to be preloaded by approx. 25% to 35% starting in particular from its completely relaxed position, i.e. for example in the state removed from the plug connector if the spring element is received in the plug connector. However, it is also advantageous if the spring element is not excessively preloaded, i.e. That its preload is at most 45% starting from its fully relaxed length when the spring element is received in the plug housing.

Together, the above-mentioned measures contribute to the spring element being able to optimally produce its spring effect and thus an optimal preload of the contact carrier in the direction of the mating plug connector supported by the plug housing.

For example, a plurality of spring elements can be provided, for example two spring elements or three spring elements, which delimit an interior, for example in which the contact carrier and/or the attachment cable are or can be arranged.

It is preferred if the spring element is or comprises a coil spring.

A preferred design provides that the contact carrier is received in an interior of the spring element. For example, the coil spring can have a passage opening, in which the contact carrier engages or which penetrates the contact carrier.

Advantageously, it is also preferred if the spring element is supported on a radial outer circumference of the contact carrier. The support can be provided directly on a circumferential surface of the contact carrier, or also on a bearing element which itself is supported on the contact carrier.

Furthermore, it is possible that the contact carrier protrudes in front of the spring element towards the cable sleeve. Thus, for example, the contact carrier can sheath the attachment cable and provide a radially outer protection for the attachment cable with respect to the spring element.

Expediently, at least one bearing body is arranged between the spring element and the plug housing and/or between the spring element and the contact carrier. The bearing body is rotatably mounted about the plug axis with respect to the plug housing or the contact carrier or both. Alternatively or additionally to this rotatability, it is also possible for the spring element to be rotatably mounted on the at least one bearing body with respect to the plug axis. The at least one bearing body preferably forms a component of an axial bearing with respect to the plug axis.

Preferably, two such bearing bodies are provided, namely one bearing body between the contact carrier and the spring element and one bearing body between the spring element and the plug housing. Thus, for example, the sliding properties or bearing properties between the spring element and the contact carrier and/or between the spring element and the plug housing can be optimally adjusted by means of the at least one contact carrier.

The bearing body is, for example, a metal bearing body or a bearing body made of plastic.

A thermoplastic material with favourable wear and sliding properties is suitable for the bearing bodies. Polyoxymethylene (POM), polytetrafluoroethylene (PTFE), polybutylene terephthalate (PBT) or similar are preferred.

Expediently, the bearing body has a pipe section or a sleeve section in which the contact carrier engages and/or in which the contact carrier is rotatably received. The pipe section can also be provided such that it engages in the spring element or is arranged between the contact carrier and the spring element. It is particularly advantageous if the pipe section or the sleeve section is arranged sandwiched radially between the contact carrier and the spring element, which is preferably designed as a coil spring. Thus, the spring element does not rest directly on the outer circumference of the contact carrier, but on the bearing body or the pipe section thereof.

It is advantageous if the bearing body still has a supporting section protruding radially in front of the pipe section, in particular at its longitudinal end, to support the spring element in the direction of the plug axis. The supporting section is, for example, designed as a collar or a flange projection.

The supporting section radially protruding in front of the pipe section is expediently supported on a supporting contour running transversely to the plug axis, for example a step of the contact carrier or of the plug housing. The supporting section and the supporting contour of the contact carrier preferably lie flat against one another, but slidably relative to one another.

The bearing body can from the above-mentioned or a supporting body supported on the plug housing via which the spring element is supported on the plug housing with respect to the plug axis.

The bearing body expediently comprises a sliding sleeve, a sliding disc or similar. The sliding sleeve can, for example, have the collar section or a radially protruding section which is designed or provided for supporting the spring element. The plug housing can be one part.

A preferred variant provides that the plug housing has a front housing part and a rear housing part which is or can be connected to the front housing part by means of connecting means. The two housing parts, the front housing part and the rear housing part, are arranged behind one another with respect to the plug axis. The front housing part and the rear housing part can have sections engaging in one another, for example pipe sections or sleeve sections. Preferably, anti-rotation contours are defined on the front housing part and the rear housing part to prevent the front housing part and the rear housing part from rotating with respect to the plug axis or the axis of rotation around which the plug housing can rotate with respect to the contact carrier.

Furthermore, it is advantageous if the connecting means have latching contours, for example latching hooks, latching projections or similar, with which the front housing part and the rear housing part are or can be latched to one another. Alternatively or additionally, the front housing part and the rear housing part can also be screwed and/or glued and/or clamped together or otherwise connected in some other way.

It is further advantageous if the front housing part and the rear housing part are connected to one another in a rotationally fixed manner with respect to the plug axis by means of the connecting means. The connecting means or anti-rotation contours can thus have longitudinal projections and longitudinal recesses, for example, which run parallel to the plug axis.

The two or more-part plug housing makes it possible to simply mount the above-mentioned components, for example the spring element and the contact carrier.

Preferably, a plug opening is provided on the plug housing, for example the front housing part, in which the contact carrier is received for plugging into the mating plug connector.

It is preferred if the rear housing part is designed for receiving the spring element, i.e. such that it has a recess for the spring element.

However, at this point it should be mentioned that the spring element is not or does not have to be in direct contact with the plug housing. It is particularly preferred if the spring element has a distance from the plug housing. The plug housing preferably has a spring chamber in which the spring element is arranged radially at a distance from the inner circumference of the spring chamber.

Expediently, grip contours, for example grip depressions, hollows, corrugations, rubber coatings or similar, are provided on the plug housing for manual operation. It is preferred if such grip contours are arranged on the front housing part.

The cable sleeve is preferably designed as kink protection. The cable sleeve sheaths the attachment cable or is provided such that is does not kink in the exit region from the plug housing.

The plug housing, in particular the rear housing part, expediently has a holder or a recess for the cable sleeve.

Preferably, the cable sleeve is held on the plug housing transversely and/or longitudinally to the plug axis in a non-displaceable or substantially non-displaceable manner. For example, a radially inward protruding projection or collar of the plug housing can engage in the cable sleeve. Expediently, a retaining contour, for example a retaining depression or a retaining projection, is provided on the cable sleeve radially to its longitudinal axis for form-fit engagement with a mating retaining contour of the plug housing, which also runs radially to the longitudinal axis of the cable sleeve.

Nevertheless, it is advantageous if the cable sleeve and the plug housing can be rotated relative to one another. Thus, the operator can rotate the plug housing relative to the cable sleeve, which in turn is not or does not have to be or cannot be rotated with respect to the attachment cable.

It is preferred if such cable sleeve can be rotated relative to the attachment cable. For example, a passage opening of the cable sleeve has a passage cross-section for the attachment cable in which the attachment cable is received with movement play. This allows the cable sleeve to rotate around the attachment cable, which is preferably not rotatable with respect to the contact carrier, when rotated relative to the contact carrier.

It is advantageous if the plug contacts are designed as plug sockets received in the contact carrier, which plug sockets have sections which are movable with respect to the contact carrier transversely to the plug axis or are moveable transversely to the plug axis, in particular as a whole. This means that the plug sockets are floating or movable on or in the contact carrier, either completely or in sections across the plug axis.

An independent invention in itself represents the following measure, which is also advantageous in connection with the invention. However, in this invention, which is in itself an independent invention, all of the features already explained can easily be realised individually or in combination.

In connection with the features of the preamble of claim 1 or also in combination with the features already described, it is advantageously provided that the contact carrier has a contact carrier body in which the plug contacts are received or which carried the plug contacts, and a cable holder body which is moulded, in particular injection-moulded or moulded by a casting process, onto the contact carrier body, by means of which the attachment cable is held or can be held stationary with respect to the plug contact. Preferably, the attachment cable is overmoulded by the material of the cable holder body or the material of the cable holder body is cast on the attachment cable. This results in a construction that keeps the attachment cable stationary with respect to the plug contacts and is largely or completely insensitive to mechanical stress. In particular, the contact carrier, preferably the cable holder body, can optimally support the forces of the spring element. The plug contacts are received in the contact carrier body with movement play, for example transversely to the plug axis and/or parallel to the plug axis. Thus, a contacting of the mating plug contact is improved.

Of course, this embodiment is also advantageous if the spring element is provided separately from the cable sleeve.

The cable holder body expediently has retaining contours for holding a sheath of the attachment cable, as well as conductor ends, in particular stranded wire ends of the attachment cable protruding in front of the sheath to the plug contacts. It is therefore advantageous if both the sheath and the conductor or stranded wire ends of the attachment cable are received in the cable holder body. The retaining contours hold the sheath of the attachment cable and/or the conductor ends or stranded wire ends of the attachment cable stationary parallel and/or transversely to the plug axis with respect to the plug contacts. The retaining contours are formed, for example, when the cable holder body is cast or moulded onto the contact carrier body.

Expediently, the cable holder body has a Young's modulus between 500 $N/mm^2$ and 13,500 $N/mm^2$. It is particularly preferred if the Young's modulus is between 1300 $N/mm^2$ and 6000 $N/mm^2$. Thus, the cable holder body is substantially bending-resistant and can keep mechanical loads away from the attachment cable or its attachment section, which is received in the plug housing.

In the case of the contact carrier body and/or the cable holder body, it is advantageous if it is made of a thermoplastic material, which can be designed without fibre reinforcement or with fibre reinforcement. For example, the thermoplastic material can be glass fibre reinforced. Preferably, the plastic material of the contact carrier body and/or the cable holder body is polyamide (PA), polypropylene (PP), polybutylene terephthalate (PBT), polycarbonate (PC), acrylonitrile butadiene styrene (ABS). The plastic of the contact carrier body is preferably provided with a flame retardant. Polyamide 6, for example, is particularly preferred as a material for the contact carrier body.

In principle, it is possible that the contact carrier and the plug housing do not lie directly against one another, or at least are mounted on each other using a bearing separate from both components.

However, an embodiment is preferred in which the contact carrier has a longitudinal section or a centring section on which the plug housing is rotatably and/or displaceably and/or slidably mounted. It is therefore advantageous if the plug housing is mounted directly on the contact carrier. Thus, it is not necessary for the plug housing to lie completely against the bearing section in the circumferential direction.

Rather, a transverse play with respect to the plug axis is advantageous. The plug housing is advantageously mounted on the bearing section with play, which makes centring of the contact carrier with respect to the mating plug connector possible. It is therefore advantageous if the plug housing has a movement play relative to the contact carrier transverse to the plug axis.

In terms of space, it is advantageous if the spring element and the bearing section are arranged next to one another or behind one another in relation to the plug axis.

The spring element is expediently received between the bearing section of the centring section and the cable sleeve in the plug housing.

Furthermore, it is particularly preferred if the spring element has a radial distance transverse to the plug axis from the plug housing. Therefore, the spring element is preferably not in direct contact with the plug housing.

The attachment cable is preferably used for electrical connection to an electrical power supply network, in particular to an AC voltage network. The attachment cable comprises two conductors or three conductors, for example. For example, one of the conductors is a phase conductor and the other conductor is a neutral conductor, but their roles can be reversed. A third conductor is, for example, a protective conductor. For each conductor the plug connector preferably has at least one plug contact which is insulated from other plug contacts. A plug connector according to the invention is provided at a longitudinal end of the attachment cable, while at the other longitudinal end there is also a plug connector according to the invention or an attachment plug for connection to an electrical power supply network or other power source.

The plug contacts can comprise plug sockets, plug pins, plug projections or similar.

The plug connector expediently has at least one mechanical coding, associated with its electrical properties and/or the electrical properties of the attachment cable. The mechanical coding can, for example, comprise projections, cavities, mechanical contours, form-fit contours or similar. The electrical properties are, for example, a maximum current that can be conducted via the attachment cable or the plug connector, a supply voltage or similar. Preferably, the coding is arranged in the region of the contact carrier or on the contact carrier, close to the plug contacts. However, coding could also be possible without further effort, for example in the region of the rotary form-fit contours or at any other point on the plug housing.

The mating plug connector thus has corresponding codings so that only such a plug connector can be plugged into a mating plug connector whose electrical properties and/or in which the electrical properties of the attachment cable connected to the plug connector are suitable for the electrical appliance having the mating plug connector.

A mains plug for connection to an electrical power supply network, in particular an alternating voltage network, is expediently arranged on the attachment cable.

BRIEF DESCRIPTION OF THE DRAWINGS

In the following, an exemplary embodiment of the invention is described in more detail on the basis of the drawing, wherein.

DETAILED DESCRIPTION

Figure 1:
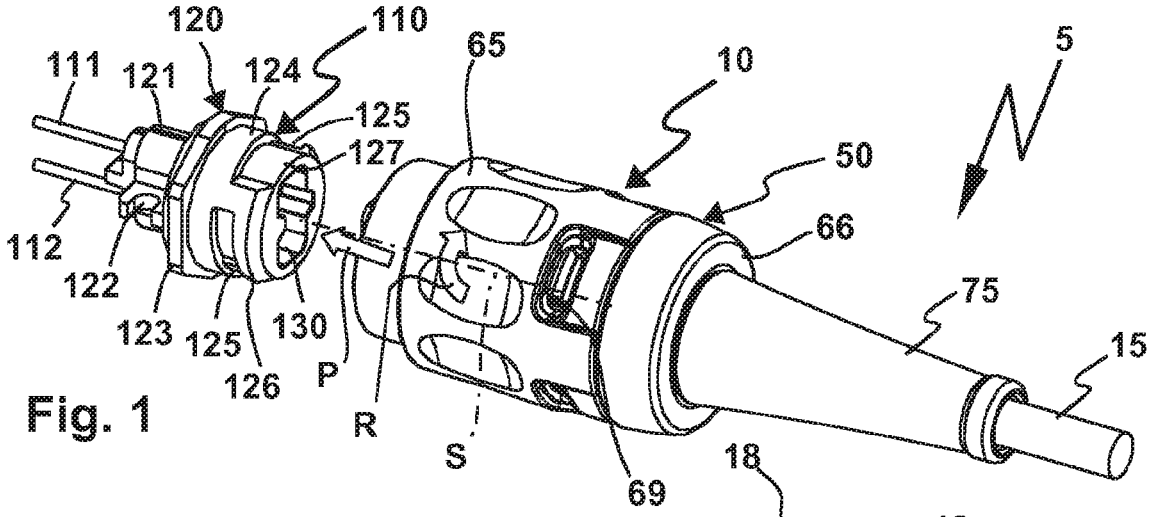
FIG. 1 shows a perspective oblique view of a plug connector and a mating plug connector in the state not yet connected to one another.
Figure 2:
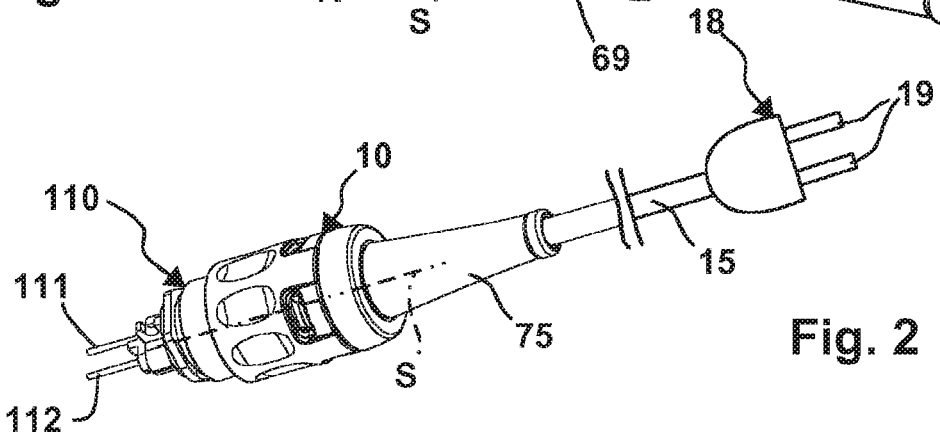
FIG. 2 shows a perspective oblique view of the above-mentioned components but in the state connected to one another.
Figure 3:
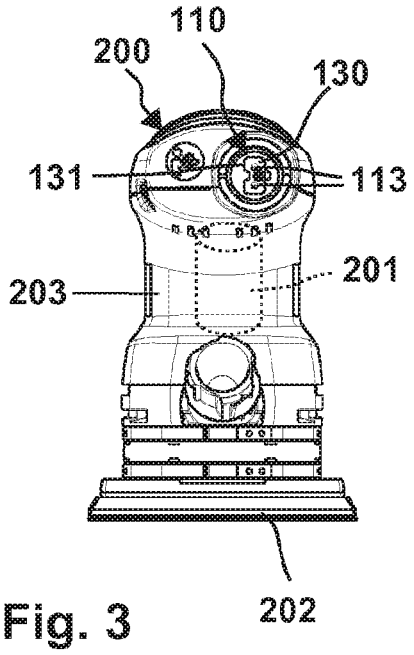
FIG. 3 shows a rear view of a hand-held machine tool having a mating plug connector for a plug connector according to the invention in the form of a grinding machine.
Figure 4:
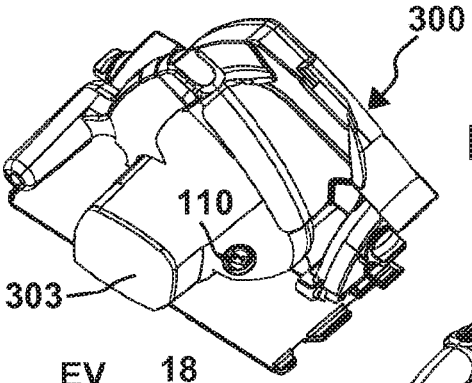
FIG. 4 shows a perspective oblique view of a hand-held machine tool in the form of a saw having a mating plug connector for a plug connector according to the invention.
Figure 5:
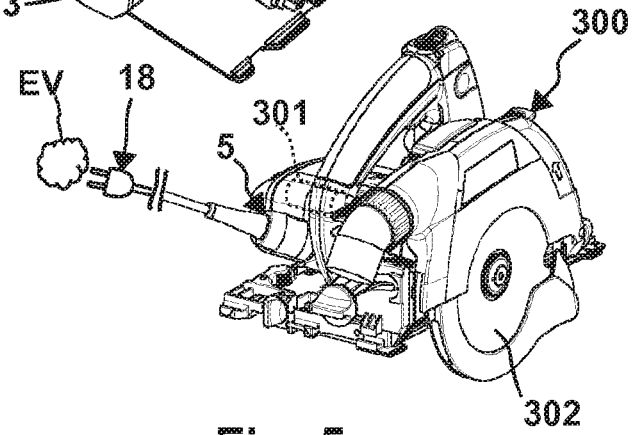
FIG. 5 shows a perspective oblique view of the hand-held machine tool in FIG. 4 having a connected plug connector according to the invention.
Figure 6:
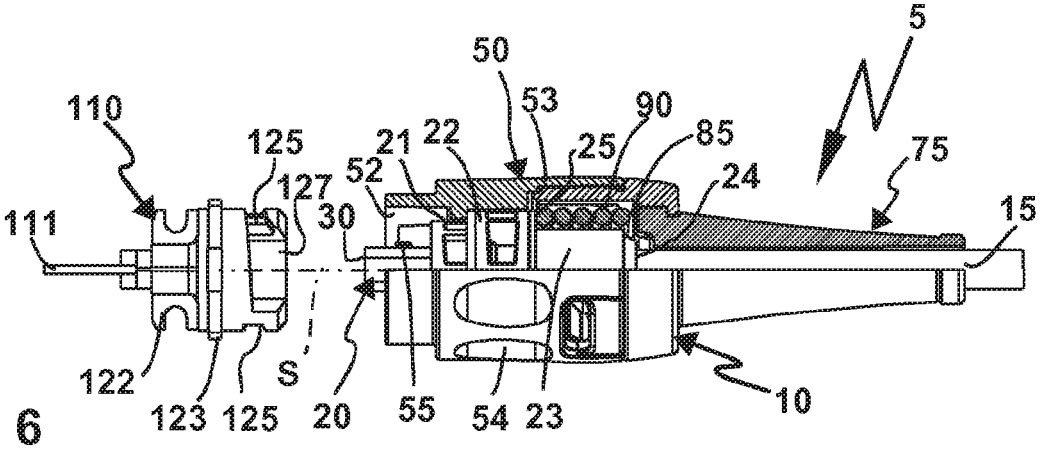
FIG. 6 shows a side view of the arrangement according to FIG. 5 in a partially cut state of the plug connector.
Figure 7:
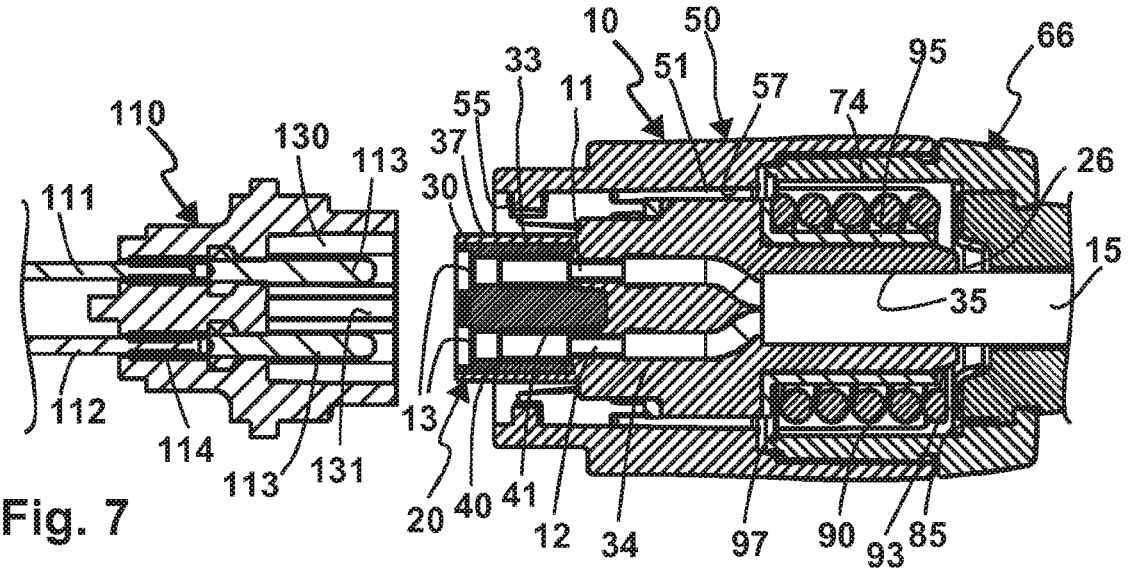
FIG. 7 shows a longitudinal section through the configuration according to FIG. 1.

An electrical attachment system 5 according to the drawing comprises a plug connector 10, which is arranged on an end region of an attachment cable 15, on the other end of which an attachment plug 18, for example a so-called mains plug for 110 V, 230 V or similar is arranged. The attachment cable 15 comprises two conductors, in particular stranded wire ends 11, 12 which are assigned different potentials. However, the attachment plug 18 can be connected in different orientations to a power supply network EV, so that on the one hand one conductor 11, on the other hand the other conductor 12, for example, is in electrical connection with the phase, while the respective other conductor 12, 11 is in electrical connection with the neutral conductor of the power supply network EV or an attachment contact therefor. A third conductor could easily be provided as a protective conductor in the attachment cable 15.

The plug connector 10 has plug contacts 13, for example plug sockets, which are electrically connected to the electrical conductors 11, 12 of the attachment cable 15, which are in particular designed as stranded wires, on the one hand, and electrically connected to plug contacts 19 of the attachment plug 18 or the mains plug, on the other hand. The electrical conductors 11, 12 are electrically insulated in a sheath 16 of the attachment cable 15. Each electrical conductor 11, 12 is further provided with an insulating sheath or insulation 17.

The electrical conductors 11, 12 are mechanically and electrically connected to the plug contacts 13, for example by means of a crimp connection 14.

The plug connector 10 and the attachment cable 15 serve to supply electrical energy to electrical appliances in the form of, for example, a hand-held machine tool 200, in particular a grinder, or a hand-held machine tool 300 in the form of, for example, a hand-held circular saw. The attachment cable 15 with the plug connector 10 can also easily be used to supply power to a vacuum cleaner or other similar electrical appliance. The hand-held machine tools 200, 300 have drive motors 201, 301 which serve to drive a working tool 202, 302, for example a plate tool, a grinding tool, a saw blade or similar. The drive motors 201, 301 are alternating current motors, for example. The hand-held machine tools 200, 300 can be supplied with electrical current from the power supply system EV via the attachment cable 15 and the plug connector 10. The plug connector 10 can optionally be installed on each hand-held tool machine 200, 300 so that it can be used in a flexible manner. In particular, a longer or shorter attachment cable, if required, can be easily connected to the respective hand-held machine tool 200, 300, wherein a reliable, electrically safe connection is required during operation of the hand-held machine tool 200, 300. Such a mechanically and electrically resilient connection can easily be realised with the plug connector 10, which can be detachably connected to a mating plug connector 110 of the hand-held machine tool 200 or the hand-held machine tool 300.

From the mating plug connector 110, attachment cables 111, 112 lead to an electrical power supply of the hand-held machine tool 200, 300, for example, control electronics for the drive motors 201, 301 or similar. The mating plug connector 110 has mating plug contacts 113 corresponding to the plug contacts 13, for example, plug projections which can be inserted into the plug contacts 13, which are designed as plug sockets, namely along a plug axis S. The plug actuation corresponds to an arrow direction of an arrow P in FIG. 1. The mating plug contacts 113 are connected to the attachment lines 111, 112 by means of attachment sections 114.

The mating plug contacts 113 are arranged on a contact carrier 120 which is connected to or forms an integral component of the respective housing 203, 303 of the hand-held machine tool 200, 300. By way of example, the contact carrier 120 is secured on each housing 203, 303 of the hand-held machine tool 200, 300 by means of a securing section 121. On the fixing section 121, fixing contours 122, for example screw holes, undercuts or the like, can be provided for fixing to the hand-held machine tool 200, 300. For example, a flange section 123 is supported by the housing 203, 303 of the hand-held machine tool 200, 300.

In front of the flange section 123 of the contact carrier 120, a plug projection 124 protrudes for insertion into the plug connector 10. On the plug projection 124, mating rotary form-fit contours 125 are provided, into which rotating form-fit contours 55 of the plug connector 50 can be engaged. The mating rotary form-fit contours 125 and the rotary form-fit contours 55 form screw contours, bayonet contours or similar, for example. In the exemplary embodiment, the rotary form-fit contours 55 are L-shaped, for example, and can be plugged into the plug projection 124 in the region of plug-in regions 127, and brought into form-fit engagement with the mating rotary form-fit contours 125 by a rotation movement R (FIG. 1) so that they engage with rear retaining projections 126 of the mating rotary form-fit contours 125.

The mating plug contacts 113 are received in the plug receptacle 130, on the inner circumference of which a coding 131 is provided. The coding 131 corresponds to a coding 31 of the plug connector 10 if this is suitable for the electrical power supply of the hand-held machine tool 200 or 300. In particular, the codings 131, 31 ensure, for example, that only an attachment cable 15 suitable for the power supply network EV is plugged in, e.g. an attachment cable 15 suitable for a 110 V or 240 V alternating voltage network, or that the maximum current that can be conducted via the attachment cable 15 is sufficient to supply the hand-held machine tool 200, 300 with power without the attachment cable 15 overheating. The codings 131, 31 are, for example, projections, coding contours or the like protruding radially inwards or radially outwards with respect to the plug axis S.

The mating plug connectors 110 are thus firmly integrated into the housing structure or housing 203, 303 of the hand-held machine tool 200, 300. The mating plug contacts 113 are immovable and stationary with respect to the contact carriers 120, so that a reliable hold of the plug connector 10 on the respective mating plug connector 110 can be established by movable and adjustable components of the plug connector 10.

The plug connector 10 has a contact carrier 20 on which the plug contacts 13, i.e. the sockets, are held. At this point, it should also be noted that instead of the sockets in a plug connector according to the invention, a fixed plug contact or plug projection can also be provided, for example in the type of mating plug contacts 113. The functional principle described in the following also functions in this situation. Combinations of plugs and plug projections are also easily possible with a plug connector according to the invention.

Figure 8:
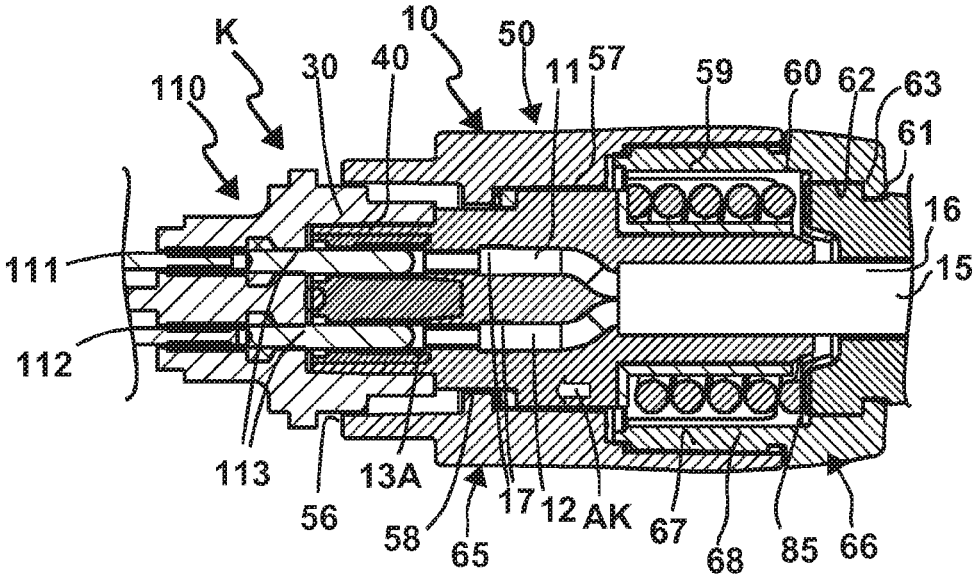
FIG. 8 shows a longitudinal section through the plug connector and the mating plug connector connected to one another corresponding to FIG. 2.
Figure 9:
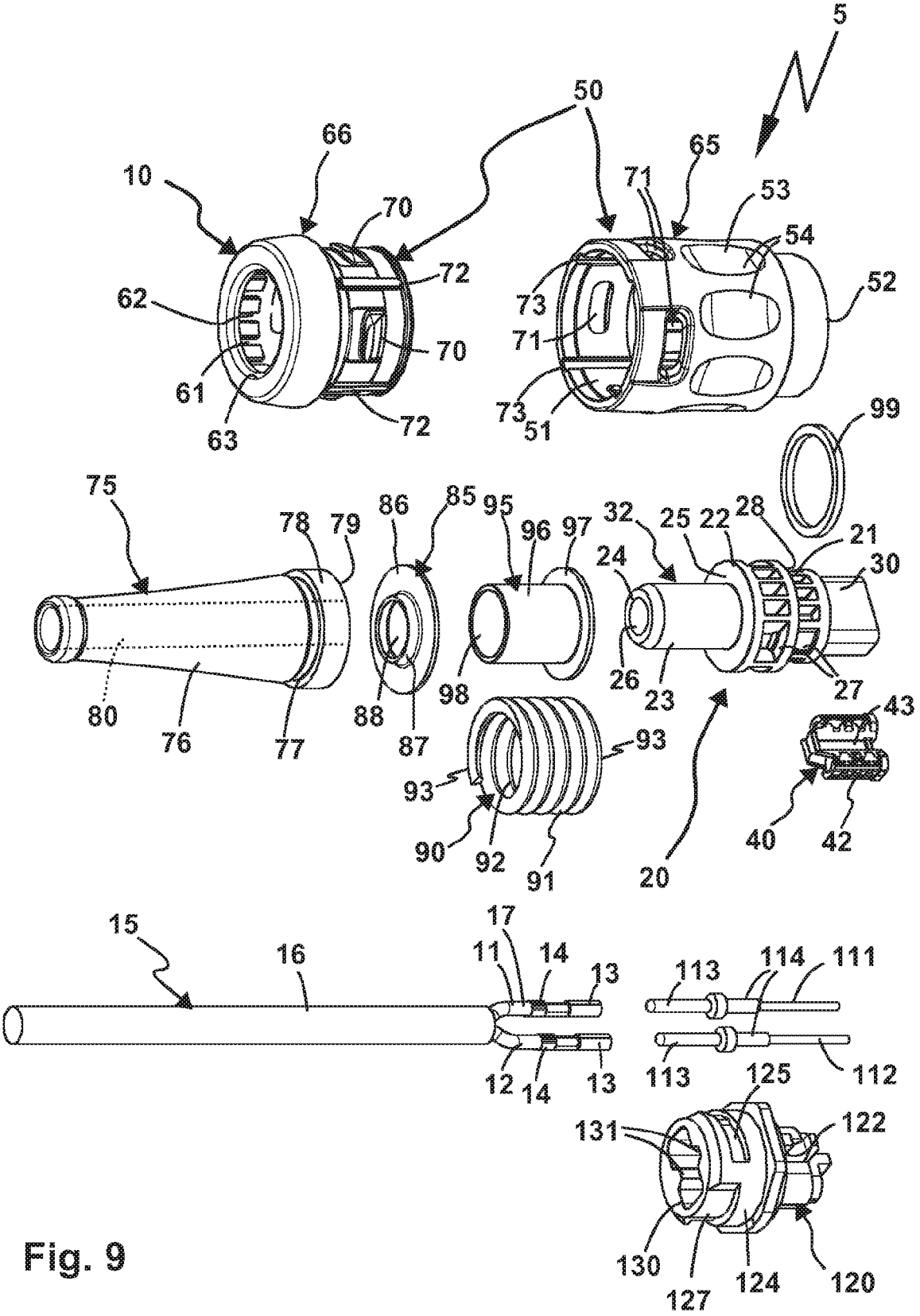
FIG. 9 shows an exploded view from diagonally in front.
Figure 10:
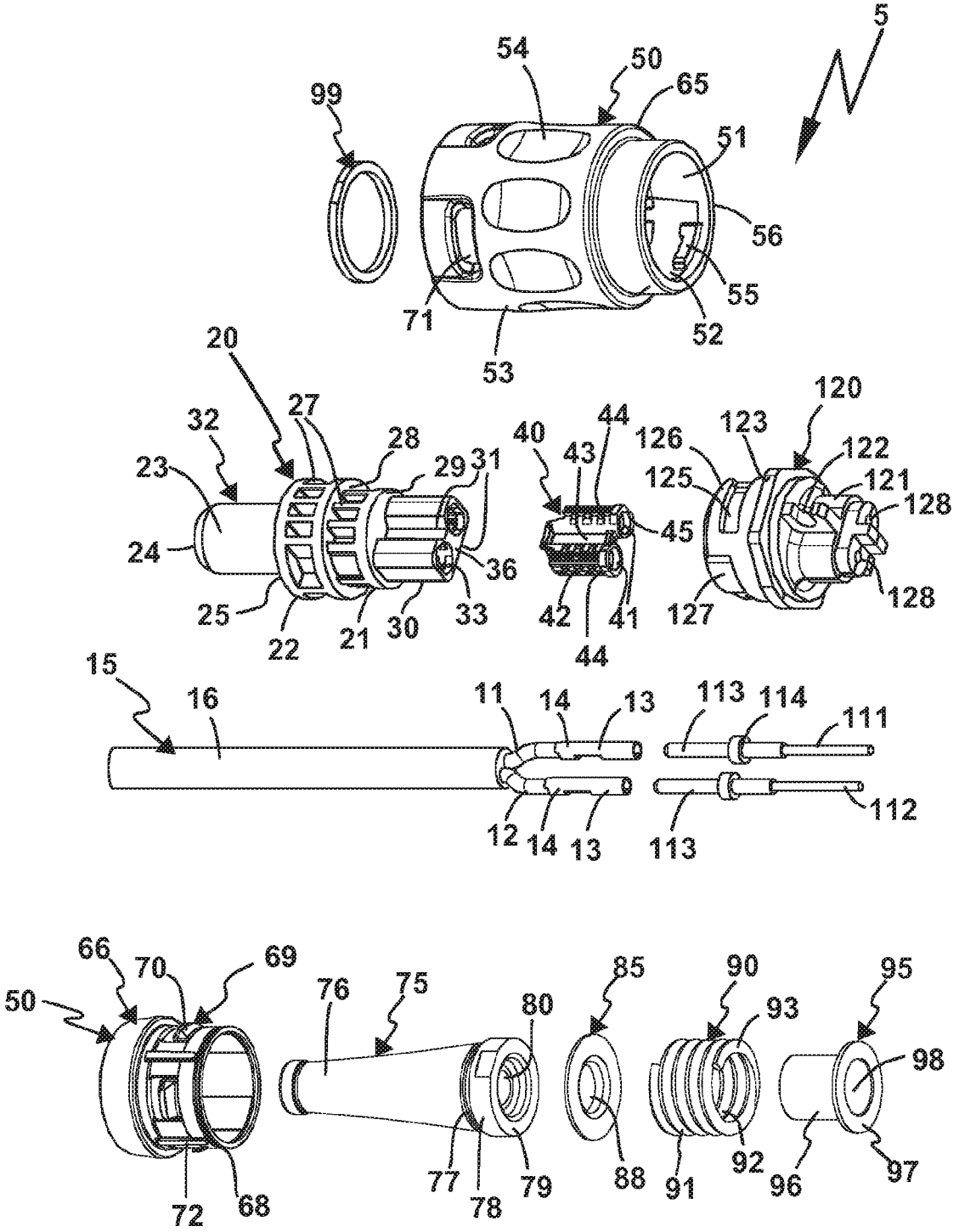
FIG. 10 shows an exploded view of the plug connector according to the preceding figures from diagonally behind.

The contact carrier 20 has a supporting section 21, in front of which a plug projection protrudes to be plugged into the plug receptacle 130 of the mating plug connector 110. Plug contacts 13 are arranged in the plug projection 30. The plug housing 50 is mounted on the contact carrier with respect to the plug axis S or with respect to the contact carrier 22 with longitudinal displacement or, in the opposite formulation, the contact carrier 20 is mounted in the plug housing 50 with longitudinal displacement along the plug axis S. Consequently, the sleeve-like plug housing 50 can be moved back and forth along the plug axis S on the contact carrier 20, wherein in the position shown in FIG. 8, in which the plug housing 50 is moved away from the plug projection 30 (to the right in the drawing), the rotary form-fit contours 55 are in engagement with the mating rotary form-fit contours 125.

The supporting section 21 is arranged in relation to the plug axis S between the plug projection 30 and a bearing section 22, which can also be referred to as the centring section. On the bearing section or centring section 22, the plug housing 50 can be supported or centred in any longitudinal position with respect to the plug axis S. The plug housing 50 thus does not have to be supported on the full circumference of the bearing section or centring section 22, but only on a partial circumference. Therefore the plug housing 50 has a little play at right angles to the plug axis S with respect to the contact carrier 20, so that the mating plug contacts 113 can be brought into engagement, and yet the plug housing 50 can not only be rotated about the plug axis S, but can also be moved at right angles to the plug axis S to such an extent that a plug receptacle 52 of the plug housing 50 provided at the front, free end region of the plug connector 10 can be plugged into the contact carrier 120, i.e. the plug projection 125 of the mating plug connector 110 can be inserted into the plug receptacle 52 in order to bring the plug contacts 13 into contact with the mating plug contacts 113, i.e. to establish a contact position K.

In this contact position K, it is possible to bring the rotary form-fit contours 55 into form-fit engagement with the counter rotary form-fit contour 125.

In addition to the bearing section 22, the contact carrier has a spring section 23 on which a spring element 90 is arranged. The spring element 90 loads the contact carrier 20 with a contact pressure AK in the contact position K shown in FIG. 8, namely in the direction of the mating plug connector 110, wherein the spring element 90 is supported by the plug housing 50, which is held on the mating plug connector 110 by means of the form-fit contours 55 as well as the mating rotating form-fit contours 125 on the mating plug connector 110 so that the plug contacts 13 (the sockets) are held or are held in electrical contact with the mating plug contacts 113 (the plugs or plug projections) of the mating plug connector 110.

At a longitudinal end 24 of the contact carrier 20 facing away from the plug projection 30, the attachment cable 15 including its sheath 16 is led out of the contact carrier 20 at an outlet opening 26.

A step is provided between the spring section 23 and the supporting section 21.

The spring section 23 has a smaller diameter than the supporting section 21 with respect to the plug axis S or the axis of rotation, which results in the step or a bearing supporting surface 25 running transverse to the plug axis S. The spring element 90 is supported on the bearing supporting surface 25. For example, the spring element 90 can lie directly on the bearing supporting surface 25. However, in each case a bearing body 95 is provided, which is arranged sandwiched between the contact carrier 20 and the spring element 90.

The bearing body 95 has a tube section 96 in which the spring section 23 engages and in front of which the spring section 23 even protrudes in the direction of a cable sleeve 75, which is held on the plug housing 50.

In front of the pipe section 96, a supporting section 97, for example in the form of a collar or a flange, protrudes radially outwards and is supported by the bearing supporting surface 25. The supporting section 97 is arranged between a longitudinal end 93 of the spring element 90 and the bearing supporting surface 25.

An inner circumference of a passage opening 98 of the bearing body 95 corresponds approximately to an outer circumference of the spring section 23. which is approximately cylindrical, for example, so that the bearing body 95 and the contact carrier 20 are mounted on one another so as to be rotatable with respect to the plug axis S.

The plug projection 30 protrudes in front of a stop surface 29 of the contact carrier 20 or the cable holder body 32, which can, for example, stop frontally on the mating plug connector 110.

Between the supporting section 21 and the bearing section 22 there is a further step, which is formed by the smaller outer circumference of the supporting section 21 compared to the bearing section 22. A bearing supporting surface 28, i.e. a supporting surface or bearing surface extending transversely to the plug axis S, is formed on this step, against which the plug housing 50 can stop with a longitudinal stop 58 in its longitudinal position (shown in FIG. 8) which compresses the spring element 90 to a maximum amount. A further bearing body 99 is provided on the stop surface 29, for example a ring, a ring-shaped disc, an O-ring-shaped body or the like. The bearing body 99 fulfils the function of an axial bearing ring or an axial bearing body. The bearing body 99 is penetrated by the contact carrier 20 or rests on its outer circumference, in particular on the supporting section 21 next to the stop bearing support surface 28.

By means of the bearing bodies 95, 99, there are therefore two axial bearing bodies in relation to the plug axis S or longitudinal plug axis of the plug connector 10.

To reduce the amount of material required, to avoid air inclusions or the like, it is advantageous if recesses, ribs or the like are provided on the contact carrier 20. For example, the supporting section 21 and the bearing section 22 have a ribbed structure 27, i.e. an arrangement of one or more recesses, so that an injection moulding or casting process is particularly easy to realise when manufacturing the contact carrier 20.

The contact carrier 20 is in fact designed as a multi-component part, which comprises a contact carrier body 32, on the one hand, and a cable holder body 32, on the other hand, which are firmly connected to one another. The material of the contact carrier body 32, which carries the plug contacts 13, is in fact overmoulded or overcast with the material of the cable holder body 32, so that a firm, mechanically resilient construction is provided, which at the same time provides optimum support for the end region of the attachment cable 15, which is firmly held in the contact carrier 20.

In addition, the cable holder body 32 provides the supporting section 21, the bearing section 22 and the spring section 23 and thus also the bearing supporting surface 25, i.e. it can optimally support the force of the spring element 90 without, for example, mechanically loading the end region of the attachment cable 15. No deformation work takes place in the region of the end of the attachment cable 15, which could lead to damage, for example to the crimp connections 14, the ends of the conductors 11, 12 or the like, when operating the hand-held machine tool 200, 300 and the associated vibrations. Electrical operational reliability, as well as mechanical strength and contact reliability, are always guaranteed.

The cable holder body 32 forms the radially outer region and/or the longitudinal end region of the plug protrusion 30, so that over the entire length of the contact carrier 20 with respect to the plug axis S, a solid body with respect to compressive strength and tensile strength with respect to the plug axis S is provided.

The plug contacts 13 are movably received in the contact carrier body 32. For example, the plug contacts 13 are sockets made of resilient material, for example copper sheet or similar, which have a certain amount of play within the contact carrier body 40, at least in sections, and remain movable there even if the contact carrier body 40 is enclosed by the material of the cable holder body 32.

In the contact carrier body 40, receptacles 41, for example tubular receptacles, are provided for the plug contacts 13. For example, sections 13A of the plug contacts 13 or the plug contacts 13 as a whole can move transversely to the plug axis S in the contact carrier body 40, in particular the receptacles 41.

A ribbed structure 42 is provided on the outer circumference of the contact carrier body 40, so that the material of the cable holder body 32 can interlock or form-fit with the contact carrier body 40. A longitudinal recess 43 extends between plug contact sections 44, where the receptacles 41 are provided, into which the material of the cable holder body 32 can also penetrate in order to enable a firm hold of the contact carrier body 40 on the cable holder body 32. Furthermore, the contact carrier body 40 is surrounded by the material of the cable holder body 32 even in the region of the openings of the receptacles 41 or next to it, except for free front surfaces 45, which extend around the receptacles 41. This means that the contact carrier body 40 is, so to speak, completely embedded in the cable holder body 32.

The attachment cable 15 is also embedded in the cable holder body 32. For example, it has retaining contours 33 for the contact carrier body 40, as well as retaining contours 34 for the ends of the conductors 11, 12 and a retaining contour 35 for the sheath 16. The cable 16 branches so to speak in the interior or in the material of the cable holder body 32 into the two receptacles 41 of the contact carrier body 40.

A preferred measure provides that the retaining contour 35 for the sheath 16 extends over at least about half the length of the contact carrier 20 in relation to the plug axis S, so that the attachment cable 15 is embedded with its sheath 16 in the contact carrier 20 over a long section. By way of example, the retaining contour 15 extends approximately over the length of the spring section 23 with respect to the plug axis S.

The retaining contour 34 for the conductor ends of the conductors 11, 12 is provided approximately in the region of the supporting section 21 and the bearing section 22.

Laterally past the contact carrier body 40, lateral wall sections 37 of the cable holder body 32 extend to a front wall 36, which extends next to the free front surface 45 of the contact carrier body 40.

The contact carrier 20 is essentially completely received in the plug housing 50, with the exception of a section protruding in front of the plug housing 50, namely the plug projection 30. The plug housing 40 has a receptacle 51 for the contact carrier 50.

An actuating section 53, which could also be referred to as the grip section, which is suitable for gripping the plug housing 50 and for rotary actuation R is arranged on the outer circumference of the plug housing 50. On the actuating section 53, for example, grip contours 55, in particular corrugations, recessed grips or the like, are provided to enable comfortable gripping by an operator.

The plug housing 50 is sleeve-shaped and its front face 56, which extends around the plug projection 30 of the contact carrier 20, can, for example, stop at the flange section 123 of the mating plug connector 110. In addition to the front face 56, i.e. on the inner circumference of the front section of the plug housing 50, the rotary form-fit contours 55 are provided.

In relation to the plug axis S next to the rotary form-fit contours 55, a bearing section or centring section 57 of the plug housing 50 is provided, which can be supported on the bearing section or centring section 22 of the contact carrier 20 or can be supported thereon.

The bearing section or the centring section 57 is located between the longitudinal stop 58 and a spring section 59 of the plug housing 50, which encloses the spring element 90. However, the spring element 90 does not lie radially outside against the inner circumference of the plug housing 50, but has a radial distance 74 therefrom. In this way, the spring element 90 can develop its effect, which will become even clearer in the following, only in the direction of the plug axis S.

The spring element 90 lies on a longitudinal stop 60, which is provided for the cable sleeve for the attachment cable 15 or the cable sleeve 75 in addition to a passage opening 61 for the cable sleeve. The longitudinal stop 60, is for example, provided as a step between, on the one hand, the passage opening 61 or a receptacle 62 for the cable sleeve 75 and, on the other hand, the spring section 59. It would be possible for the longitudinal stop 60 to be provided, for example, on a projection protruding radially inwards in the direction of the passage opening 61, for example a step or a collar or a flange projection, so that the spring element 90 could be supported directly on the longitudinal stop 60. In this case, however, a supporting body 85 is provided to support the spring element 90, which is, for example, plate-like or disc-like and is supported at the longitudinal stop 60, the step.

The supporting body 85 absorbs the force of the spring element 90 acting in the direction of the plug axis S completely or at least substantially, so that a section 78 of the cable sleeve 75 engaging in the receptacle 62 of the plug housing 50 is substantially or completely free from a force load of the spring element 90. The supporting body 85 transmits, so to speak, the force of the spring element 90 radially outwards into the plug housing 50.

However, it would be quite possible for the cable sleeve 75 to absorb at least part of the force of the spring element 90 or to develop an additional spring effect, for example with its section 78. The cable sleeve 75 is essentially immovable in the plug housing 50 in relation to the plug axis S and is also essentially immovable at right angles to the plug axis S, but is received in the plug housing 50 in a rotatable manner in relation to the plug axis S. A retaining projection 63 for the cable sleeve 75 is provided on the receptacle 62, which engages in a ring groove or retaining receptacle 77 of the cable sleeve 75. This allows the cable sleeve 75 to rotate around the plug axis S relative to the plug housing 50.

For example, the cable sleeve 75 is equipped with a kink protection body 76 extending in the direction of the plug axis S. The kink protection body 76 has a larger diameter in the area of the plug housing 50 and thus slightly more material than in its longitudinal region further away from the plug housing 50, where the cable 15 is led out of the cable sleeve 75. In this way, the kink protection body 76 can form a kink protection for the attachment cable 15 transverse to the plug axis S.

A passage opening 80 of the cable sleeve 75 extending from the free end region of the kink protection body 76, i.e. its front side 79, to the plug housing 50 or the section 78 preferably has an inner diameter which is slightly larger than an outer diameter of the attachment cable 15, so that the cable sleeve 75 can rotate around the attachment cable 15, for example if the plug housing 50 is rotated. This means that the attachment cable 15, which is connected to the contact carrier 20 so that it cannot be rotated in relation to the plug axis S, is not or only slightly torsionally stressed.

The supporting body 85 comprises a plate body 86, which has a passage opening 88 for the attachment cable 15. Thus, the attachment cable 15 passes through the supporting body or the plate body 86. In the region of the cable sleeve 75, the supporting body 85 may have a protruding section 87, for example a kind of collar or trough-like recess, which engages in a corresponding recess on section 78 of the cable sleeve 75. It is advantageous if the supporting body 85 lies essentially flat against the section 78, so that any forces of the spring element 90 that cannot be transmitted or transferred into the plug housing 50 can be at least partially applied to the cable sleeve 75, which in turn is immovably fixed to the plug housing 50 with respect to the plug axis S or the deflection axis of the spring element 90.

The spring element 90 comprises a coil spring 91, which has a passage opening 92. The passage opening 92 is penetrated by the bearing body 75 and by the contact carrier 20, which protrudes in the direction of the cable sleeve 75 in front of the spring element 90 up to the supporting body 85, in particular to the recess formed by the section 87. The spring element 90 is thus supported on the one hand by the supporting body 85, on the other hand by the supporting section 87 of the bearing body 95 and thus by the bearing supporting surface 25, wherein the above-mentioned components can be rotated relative to one another with respect to the plug axis S. This ensures optimum mobility in relation to the plug axis S, whereas bracing transverse to the plug axis S, for example due to torsional loading or the like, is different, in particular due to the radial distance 74 inside the plug housing 50 from the spring element 90. The spring element 90 is therefore optimally movable and can thus develop its spring effect. Thus, a contact pressure P, with which the spring element 90 loads the contact carrier 20 in the direction of the mating plug connector 110 relative to the plug housing 50, is optimally adjustable.

The spring element 90 is preloaded in the plug housing 50. For example, the spring element 90 is already precompressed by 10 to 20%, preferably 30 or 40%, so that even an axial adjustment which differs between the contact position K, in which the plug contacts 13, 113 are kept in optimum contact with one another, and a release position shown in the figure, in which the spring element 90 is somewhat more relaxed compared to the contact position K, a spring force of the spring element 90 only differs by 10 to 20%, at most by 30%. The coil spring 91 is also a metal spring, i.e. it is substantially insensitive to temperature fluctuations that occur during the normal operation of hand-held machine tools of the type of hand-held machine tools 200, 300. In the typical operating temperature ranges, the spring force of the spring element 90 is substantially constant, i.e. the functional reliability of the plug connector 10 always remains constant in all common temperature ranges.

For easier assembly of the above-mentioned components, it is advantageous if the plug housing is 50 multi-part, for example two-part. The plug housing 50 has a front housing part 65 and a rear housing part 66. The rear housing part 66 provides the connection of the attachment cable 15, i.e. it has, for example, the receptacle 62 and also features the spring section 59. However, the front housing part 65, on which the rotary form-fit contours 55 and the grip contours or the actuating section 53 are provided, also extends into the spring section 59. For example, a socket 67 of the front housing part 65 is provided there, in which a plug projection of the rear housing part 66 engages. Of course, the front and rear housing parts can also be fitted with plug receptacles and projections, i.e. a front housing part (not shown in the drawing) may have a plug projection, whereas the rear housing part has a plug receptacle.

The front housing part 65 and the rear housing part 66 can, for example be connected to one another by gluing, screwing or the like, in particular in the region of the plug projection 68 and the plug socket 67. However, latching connection is provided for in this case. Connecting means 69, which are provided for connecting the front housing part 65 to the rear housing part 66, have, for example, latching contours 70, in particular latching hooks, which can be latched with latching receptacles 71 onto the front housing part 65. The latching contours 70 can be provided with actuation slopes or setting slopes running at an angle to the plug axis S, so that the latching contours 70 are deflected when the front housing part 65 and the rear housing part 66 are plugged together, so that when these are plugged together, the plug projection 68 and the plug receptacle 67 latch into the latching receptacles 71.

Furthermore, it is advantageous if the front housing part 65 and the rear housing part 66 are connected to one another in a rotationally fixed manner with respect to the plug axis S or the axis of rotation, around which the plug housing 50 can be rotated relative to the contact carrier body 40. For example, anti-rotation projections 72 are provided on the outer circumference of the plug projection 68, which engage in anti-rotation receptacles 73 in the plug receptacle 67. For example, the anti-rotation projections 72 and the anti-rotation receptacle 73 run parallel to the plug axis S. At this point, it should be mentioned that the latching contours 70, for example the latching hooks, can already represent or form anti-rotation contours.

This means that the plug connector 70 can be easily assembled by means of a simple latching connection between the front housing part 65 and the rear housing part 66. At the same time, the spring element 90 is inserted into the spring chamber or spring section together with the contact carrier 20 and is then preloaded by attaching the front housing part 65 to the rear housing part 66.

The invention claimed is:

1. A plug connector for connecting an attachment cable to a mating plug connector of an electrical appliance, wherein the plug connector has a contact carrier having plug contacts which are connected or connectable to the attachment cable and which can be brought into an electrical contact position with mating plug contacts of the mating plug connector by a plugging movement along a plug axis, wherein the contact carrier is received, in an axially movable manner with respect to the plug axis, in a plug housing which is mounted rotatably about the plug axis with respect to the contact carrier, wherein rotary form-fit contours are arranged on the plug housing and can be brought into form-fit engagement with mating rotary form-fit contours of the mating plug connector by a rotation movement of the plug housing about the plug axis with respect to the contact carrier, such that the plug connector is secured on the mating plug connector in a tension-resistant manner with respect to the plug axis, and wherein the plug connector has a cable sleeve for the attachment cable, and wherein the contact carrier, with respect to the plug housing, is biased to the contact position in the direction of the plug axis by a spring element separate from the cable sleeve, which spring element is supported on the contact carrier and on the plug housing, wherein the plug housing has a front housing part and a rear housing part which is connected to the front housing part by means of connecting means.

2. The plug connector according to claim 1, wherein the spring element is supported on the plug housing, or wherein the spring element is supported on a spring bending section of the cable sleeve supported on the plug housing.

3. The plug connector according to claim 1, wherein the spring element is supported on the plug housing directly and/or by means of a supporting body supported on the plug housing with respect to the plug axis.

4. The plug connector according to claim 3, wherein the supporting body lies on the cable sleeve at least in sections and/or is plate-shaped and/or has a passage opening for the attachment cable.

5. The plug connector according to claim 1, wherein the spring element is made of metal or comprises a metal spring and/or the spring element is a coil spring.

6. The plug connector according to claim 1, wherein the spring element is received with a preload between the contact carrier and the plug housing.

7. The plug connector according to claim 6, wherein, during an axial adjustment of the contact carrier with respect to the plug housing along the plug axis from the contact position, there is a change in a spring force of the spring element of at most 20%.

8. The plug connector according to claim 6, wherein the spring element is preloaded by at least 20% and/or by at most 45% of its length starting from its relaxed position.

9. The plug connector according to claim 1, wherein the contact carrier is received in an interior of the spring element.

10. The plug connector according to claim 1, wherein the contact carrier protrudes in front of the spring element towards the cable sleeve.

11. The plug connector according to claim 1, wherein the connecting means have latching contours with which the front housing part and the rear housing part are latched together.

12. The plug connector according to claim 1, wherein the connecting means connect the front housing part and the rear housing part to one another in a rotationally fixed manner with respect to the plug axis.

13. The plug connector according to claim 1, wherein the cable sleeve is held on the plug housing transversely and/or longitudinally to the plug axis in a non-displaceable or substantially non-displaceable manner.

14. The plug connector according to claim 1, wherein the plug contact housing is rotatable with respect to the cable sleeve.

15. The plug connector according to claim 1, wherein the contact carrier has a longitudinal section on which the plug housing is rotatably and/or displaceably and/or slidably mounted.

16. The plug connector according to claim 1, wherein the spring element has a radial distance transverse to the plug axis from the plug housing.

17. An attachment cable having a plug connector according to claim 1, wherein the attachment cable has an attachment plug to be attached to an electrical power supply network.

18. A system comprising an electrical appliance in the form of a vacuum cleaner or a mobile machine tool and at least one plug connector according to claim 1.

19. A plug connector for connecting an attachment cable to a mating plug connector of an electrical appliance, wherein the plug connector has a contact carrier having plug contacts which are connected or connectable to the attachment cable and which can be brought into an electrical contact position with mating plug contacts of the mating plug connector by a plugging movement along a plug axis, wherein the contact carrier is received, in an axially movable manner with respect to the plug axis, in a plug housing which is mounted rotatably about the plug axis with respect to the contact carrier, wherein rotary form-fit contours are arranged on the plug housing and can be brought into form-fit engagement with mating rotary form-fit contours of the mating plug connector by a rotation movement of the plug housing about the plug axis with respect to the contact carrier, such that the plug connector is secured on the mating plug connector in a tension-resistant manner with respect to the plug axis, and wherein the plug connector has a cable sleeve for the attachment cable, and wherein the contact carrier, with respect to the plug housing, is biased to the contact position in the direction of the plug axis by a spring element separate from the cable sleeve, which spring element is supported on the contact carrier and on the plug housing, wherein at least one bearing body is arranged between the spring element and the plug housing and/or the contact carrier, which bearing body is rotatably mounted about the plug axis with respect to the plug housing and/or the contact carrier and/or on which the spring element is rotatably mounted with respect to the plug axis.

20. The plug connector according to claim 19, wherein the at least one bearing body has a pipe section in which the contact carrier engages and/or in which the contact carrier is rotatably received and/or which engages in the spring element and/or which is arranged between the contact carrier and the spring element.

21. The plug connector according to claim 19, wherein the at least one bearing body forms a supporting body supported on the plug housing via which the spring element is supported on the plug housing with respect to the plug axis.

22. The plug connector according to claim 19, wherein the at least one bearing body comprises or is formed by a sliding sleeve and/or a sliding disc.

23. The plug connector according to claim 19, wherein the plug housing has a front housing part and a rear housing part which is connected to the front housing part by means of connecting means.

24. A plug connector for connecting an attachment cable to a mating plug connector of an electrical appliance, wherein the plug connector has a contact carrier having plug contacts which are connected or connectable to the attachment cable and which can be brought into an electrical contact position with mating plug contacts of the mating plug connector by a plugging movement along a plug axis, wherein the contact carrier is received, in an axially movable manner with respect to the plug axis, in a plug housing which is mounted rotatably about the plug axis with respect to the contact carrier, wherein rotary form-fit contours are arranged on the plug housing and can be brought into form-fit engagement with mating rotary form-fit contours of the mating plug connector by a rotation movement of the plug housing about the plug axis with respect to the contact carrier, such that the plug connector is secured on the mating plug connector in a tension-resistant manner with respect to the plug axis, and wherein the plug connector has a cable sleeve for the attachment cable, and wherein the contact carrier, with respect to the plug housing, is biased to the contact position in the direction of the plug axis by a spring element separate from the cable sleeve, which spring element is supported on the contact carrier and on the plug housing, wherein the plug contacts are designed as plug sockets received in the contact carrier, which plug sockets have sections which are movable with respect to the contact carrier transversely to the plug axis or are moveable transversely to the plug axis.

25. A plug connector for connecting an attachment cable to a mating plug connector of an electrical appliance, wherein the plug connector has a contact carrier having plug contacts which are connected or connectable to the attachment cable and which can be brought into an electrical contact position with mating plug contacts of the mating plug connector by a plugging movement along a plug axis, wherein the contact carrier is received, in an axially movable manner with respect to the plug axis, in a plug housing which is mounted rotatably about the plug axis with respect to the contact carrier, wherein rotary form-fit contours are arranged on the plug housing and can be brought into form-fit engagement with mating rotary form-fit contours of the mating plug connector by a rotation movement of the plug housing about the plug axis with respect to the contact carrier, such that the plug connector is secured on the mating plug connector in a tension-resistant manner with respect to the plug axis, and wherein the plug connector has a cable sleeve for the attachment cable, and wherein the contact carrier, with respect to the plug housing, is biased to the contact position in the direction of the plug axis by a spring element separate from the cable sleeve, which spring element is supported on the contact carrier and on the plug housing, wherein the contact carrier has a contact carrier body in which the plug contacts are received and a cable holder body which is moulded, onto the contact carrier body and by means of which the attachment cable is held or can be held stationary with respect to the plug contact.

26. The plug connector according to claim 25, wherein the cable holder body has holding contours for holding a sheath of the attachment cable, as well as conductor ends or stranded wire ends of the attachment cable protruding in front of the sheath to the plug contacts.

27. The plug connector according to claim 25, wherein the attachment cable is overmoulded with the material of the cable holder body or cast with the material of the cable holder body.

28. The plug connector according to claim 25, wherein the cable holder body has a Young's modulus between 500 N/mm2 and 13,500 N/mm2.

29. A plug connector for connecting an attachment cable to a mating plug connector of an electrical appliance, wherein the plug connector has a contact carrier having plug contacts which are connected or connectable to the attachment cable and which can be brought into an electrical contact position with mating plug contacts of the mating plug connector by a plugging movement along a plug axis, wherein the contact carrier is received, in an axially movable manner with respect to the plug axis, in a plug housing which is mounted rotatably about the plug axis with respect to the contact carrier, wherein rotary form-fit contours are arranged on the plug housing and can be brought into form-fit engagement with mating rotary form-fit contours of the mating plug connector by a rotation movement of the plug housing about the plug axis with respect to the contact carrier, such that the plug connector is secured on the mating plug connector in a tension-resistant manner with respect to the plug axis, and wherein the plug connector has a cable sleeve for the attachment cable, and wherein the contact carrier, with respect to the plug housing, is biased to the contact position in the direction of the plug axis by a spring element separate from the cable sleeve, which spring element is supported on the contact carrier and on the plug housing, wherein the contact carrier has a longitudinal section on which the plug housing is rotatably and/or displaceably and/or slidably mounted, and wherein the spring element is received in the plug housing between the longitudinal section and the cable sleeve.

* * * * *